US007823230B2

(12) United States Patent
Meyers et al.

(10) Patent No.: US 7,823,230 B2
(45) Date of Patent: Nov. 2, 2010

(54) BATH TUB RAIL

(75) Inventors: Daniel Seth Meyers, Roxboro (CA); Cristian Boar, Montreal (CA); Ming Xu, Saint-Laurent (CA)

(73) Assignee: AMG Medical Inc., Montreal, Quebec (CA)

( * ) Notice: Subject to any disclaimer, the term of this patent is extended or adjusted under 35 U.S.C. 154(b) by 381 days.

(21) Appl. No.: 12/037,982

(22) Filed: Feb. 27, 2008

(65) Prior Publication Data

US 2009/0211018 A1 Aug. 27, 2009

(51) Int. Cl.
*A47K 3/022* (2006.01)

(52) U.S. Cl. ..... 4/577.1

(58) Field of Classification Search ..... 4/576.1, 4/577.1; 135/65, 75

See application file for complete search history.

(56) References Cited

U.S. PATENT DOCUMENTS

| | | | | |
|---|---|---|---|---|
| 1,376,247 | A | 4/1921 | Bishop | |
| 2,714,728 | A * | 8/1955 | Bloch | 4/577.1 |
| 3,968,524 | A | 7/1976 | Zentman | |
| 4,085,763 | A * | 4/1978 | Thomas | 135/69 |
| 4,417,361 | A | 11/1983 | Smith | |
| 4,887,323 | A | 12/1989 | DiVito et al. | |
| 5,048,131 | A | 9/1991 | Stephen | |
| 5,659,904 | A | 8/1997 | Doczy et al. | |
| 5,806,548 | A * | 9/1998 | Goldstein et al. | 135/65 |
| 6,332,230 | B1 | 12/2001 | Chang | |
| 7,203,978 | B1 | 4/2007 | Chang | |
| 2005/0217017 | A1 | 10/2005 | Moser | |

FOREIGN PATENT DOCUMENTS

| | | |
|---|---|---|
| CA | 2148521 | 11/1996 |
| DE | 8522957 U1 | 9/1985 |
| DE | 20306743 U1 | 9/2003 |

OTHER PUBLICATIONS

European Search Report dated Jul. 25, 2008, on Applicant's corresponding European Patent Application 08250727.8-2303.

* cited by examiner

*Primary Examiner*—Charles Phillips
(74) *Attorney, Agent, or Firm*—Ogilvy Renault LLP

(57) ABSTRACT

A bath tub rail assembly for use on a bath tub sidewall includes a hand grip and a clamping device. The hand grip and the clamping device are adjustably connected such that the hand grip may be adjusted in both height and angular orientation relative to the bath tube sidewall when the bath tub rail assembly is attached thereto.

10 Claims, 5 Drawing Sheets

BATH TUB RAIL

FIELD OF THE INVENTION

The invention relates to a bath tub rail assembly for use on a bath tub sidewall, and more particularly to a bath tub rail assembly which includes a hand grip adjustable in both height and angular orientation relative to the bath tub.

BACKGROUND OF THE INVENTION

It is well known in the healthcare field that bath tubs represent a safety hazard to people, particularly those in a weakened or infirm condition. Serious injury can result when a person slips and falls while entering or exiting a bath tub. Bath tub rails secured to the sidewall of a bath tub are frequently used by elderly, injured or infirm persons, to assist with getting into and out of a bath tub. Bath tub rails may also be used by others to assist in placing themselves in a sitting position in a tub and to assist in getting out of the tub after the bath. Therefore, the bath tub rails must be substantially self-supporting and must have sufficient strength and stability to support a person's full weight from various angles. Most bath tub rail products sold in the market have a clamping device at the bottom of a base body and hand grips mounted on an upper portion of the base body such that the device is clamped onto the top of a sidewall of a bath tub by the clamping device. The hand grips are usually integrated with the base body and therefore the height position and angular orientation thereof are fixed and cannot be adjusted when the bath tub rails are installed in place. Therefore, the fixed height position and angular orientation of the hand grips may not meet the needs of every user. Some prior art bath tub rails may be adjustable in angular orientation but the structure for executing the adjustment is relatively complicated.

Therefore, there is a need for a bath tub rail assembly which is adjustable in both height position and angular orientation in order to meet the needs of specific users.

SUMMARY OF THE INVENTION

In accordance with one aspect of the present invention, a bath tub rail assembly is provided for use on a bath tub sidewall which comprises a hand grip; a clamping device having first and second clamping members adjustable relative to each other for clamping opposite sides of the bath tub sidewall in order to secure the bath tub rail assembly onto the bath tub sidewall; an adjustable connector for connecting the hand grip to the clamping device so as to allow a position of the hand grip to be adjusted in both height and angular orientation relative to the bath tub sidewall; and a lock device for locking the hand grip in both a selected height position and a selected angular orientation.

In accordance with another aspect of the present invention, a bath tub rail assembly for use on a bath tub sidewall which comprises a hand grip including grip ring standing substantially upright; a clamping device having first and second clamping members adjustable relative to each other for clamping opposite sides of the bath tub sidewall to secure the bath tub rail assembly onto the bath tub sidewall; and an adjustable connector for connecting the hand grip and the clamping device, the adjustable connector including a pair of connected inner and outer tubes slidable to each other and affixed to the grip ring and the first clamping member, respectively, the outer tube defining a plurality of holes at least in two column and the inner tube including an lock pin to be selectively engaged within one of the holes in either column of the outer tube, thereby allowing secure positioning of the grip ring of the hand grip in both a selected height and a selected angular orientation relative to bath tub sidewall.

BRIEF DESCRIPTION OF THE DRAWINGS

Further features and advantages of the present invention will become apparent from the following detailed description, taken in combination with the appended drawings, in which.

It should be noted that throughout the appended drawings, like features are identified by like reference numerals.

DETAILED DESCRIPTION OF THE EMBODIMENTS

The details of the embodiments of the present invention are disclosed herein. It should be understood, however, that the disclosed embodiments are merely exemplary of the invention, which may be embodied in various forms. Therefore, the details disclosed herein are not to be interpreted as limiting but merely as the basis for teaching one skilled in the art how to make and/or use the invention.

Referring to FIGS. 1-3 and 5, a bath tub rail assembly according to one embodiment of the present invention is generally indicated by numeral 10 which includes a hand grip device 12 and a clamping device 14.

Figure 2:
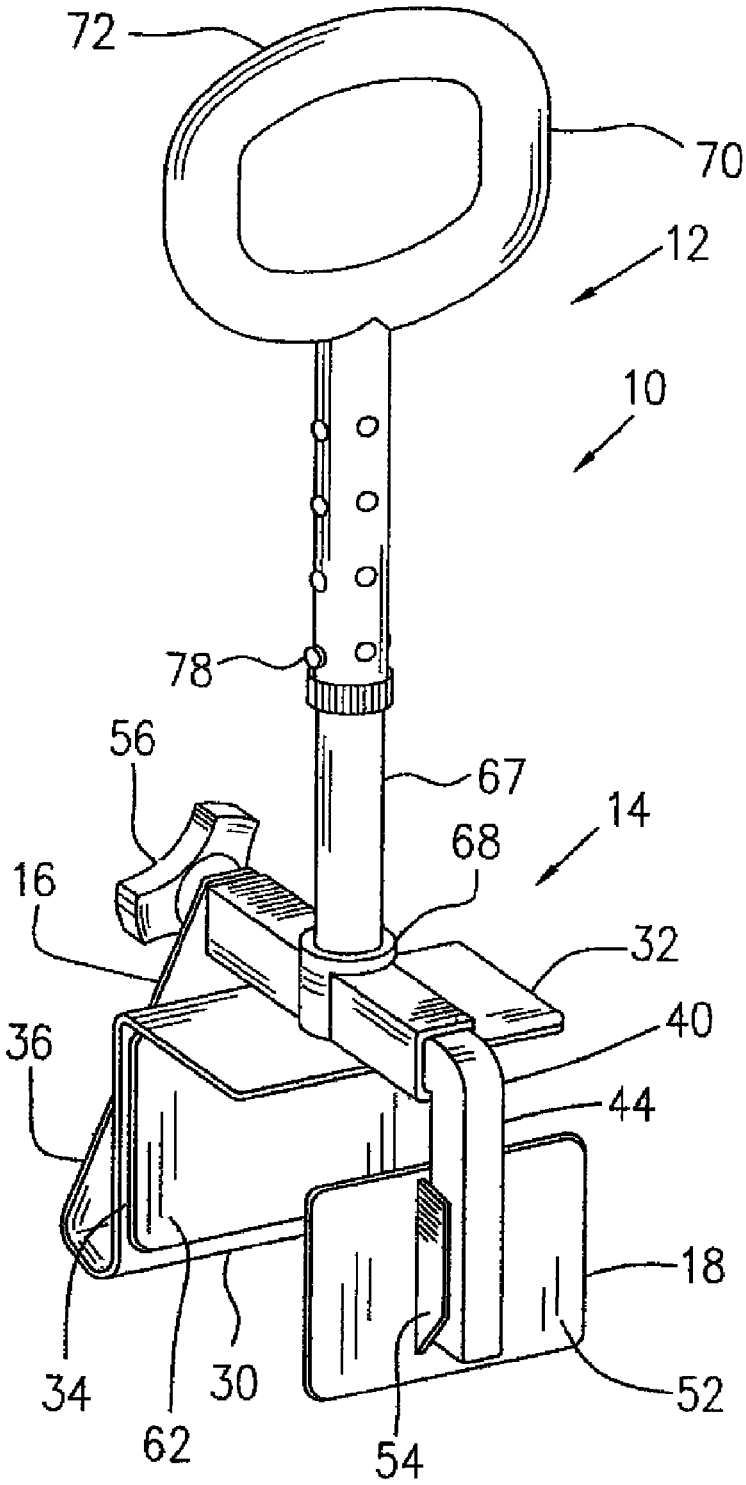
FIG. 2 is an isometric view from the other side of the bath tub rail assembly as in an assembled condition.
Figure 3:
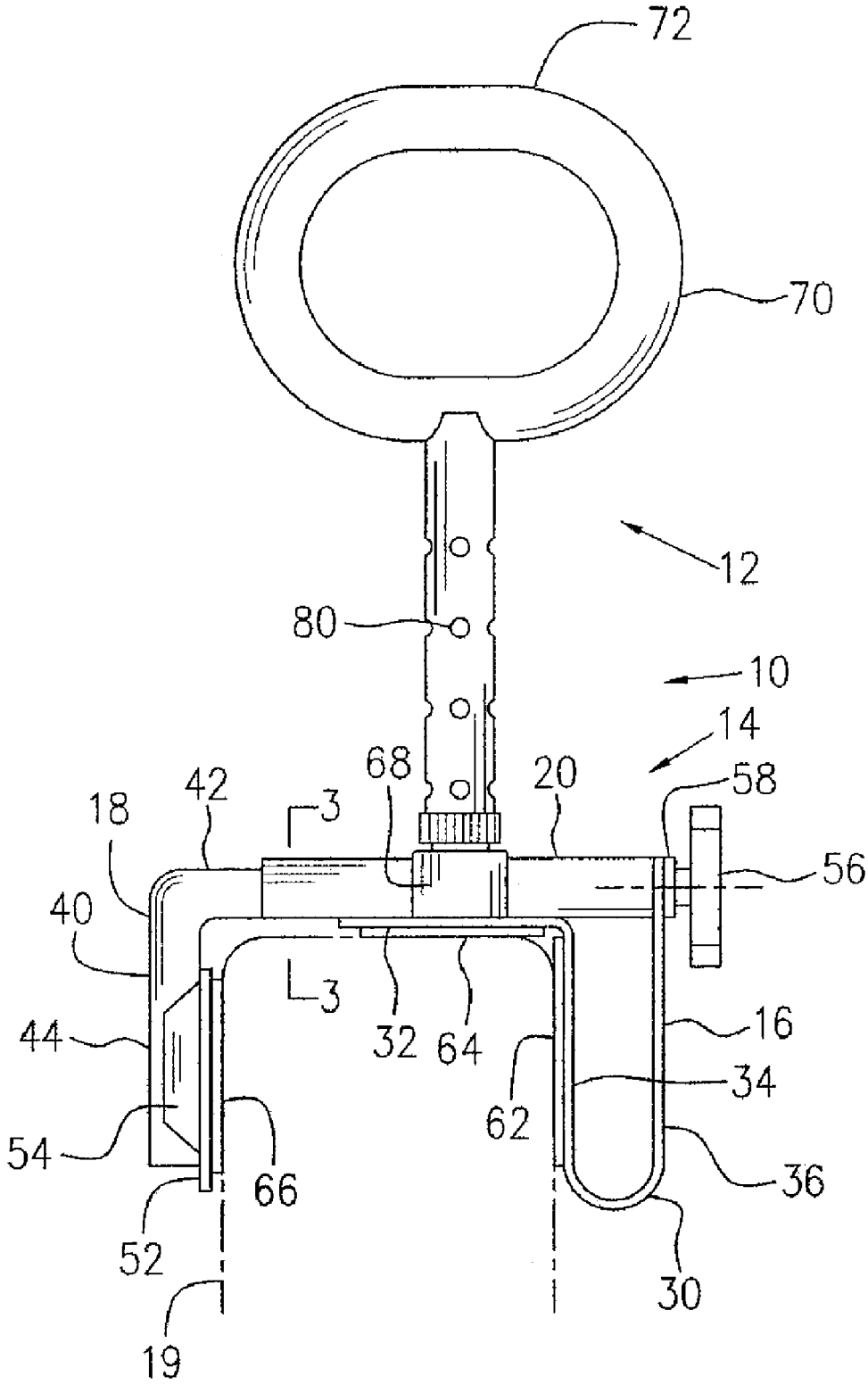
FIG. 3 is a front elevational view of the bath tub rail assembly of the embodiment of FIG. 1, showing a hand grip of the assembly adjusted in a lowest position and in an angular orientation traverse to the bath tub sidewall.
Figure 5:
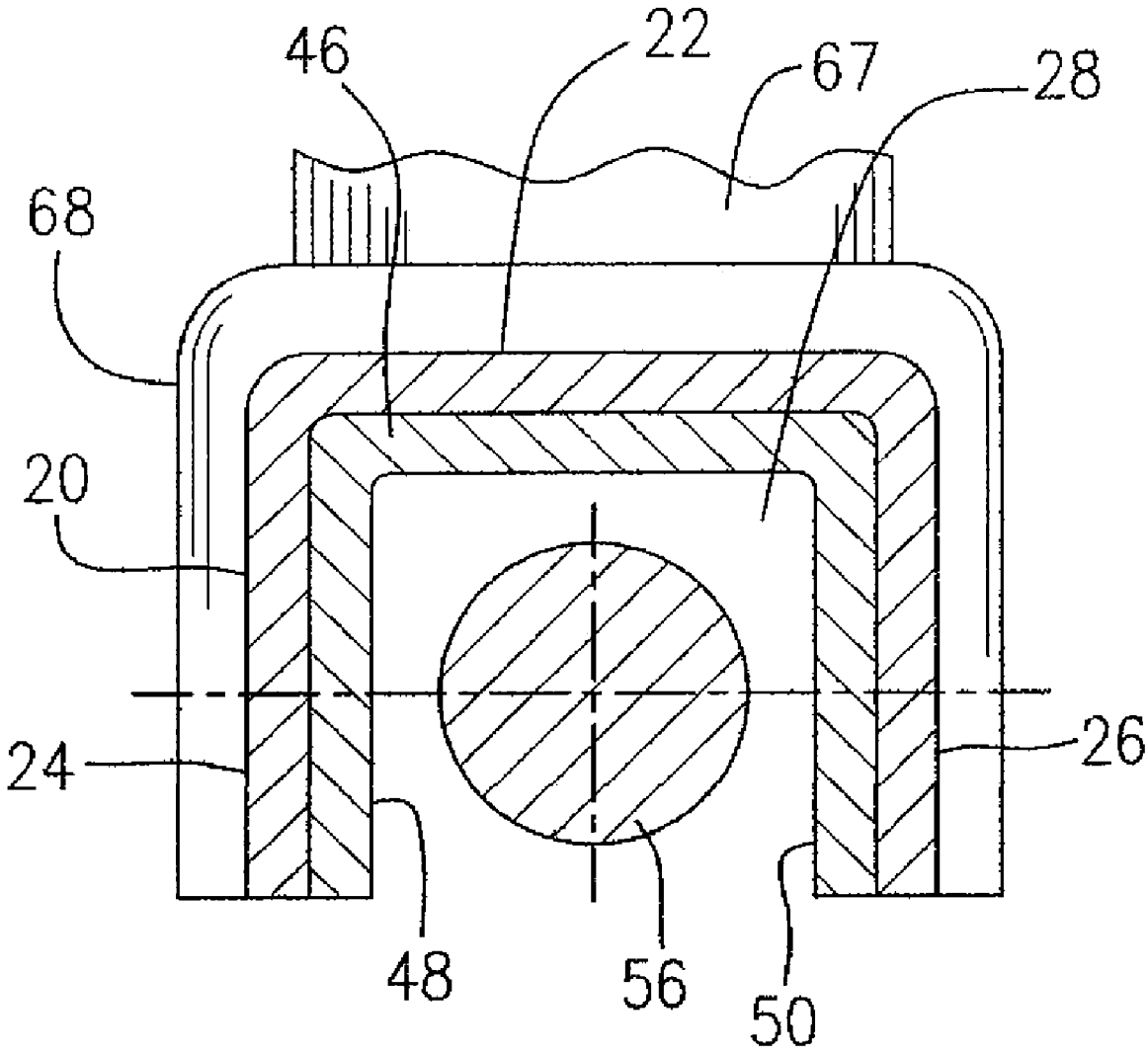
FIG. 5 is a cross-sectional view taken along line 5-5 in FIG. 3 showing the interior configuration of the clamping device of the bath tub rail assembly.

The clamping device 14 generally includes a first clamping member 16 and a second clamping member 18 which are adjustable relative to each other for clamping opposite sides of a bath tub sidewall which is indicated by numeral 19 in FIG. 3. The first clamping member 16, for example, includes a joining body such as a metal bar 20. As illustrated in FIG. 5, the metal bar 20 may include a top wall 22 and opposite sidewalls 24, 26 to define a substantially rectangular or square hollow cross-sectional configuration having an open channel 28 extending between opposite open ends and along the entire length of the metal bar 20. Referring again to FIGS. 1-3, a plate member 30 may be attached to the metal bar 20. The plate member 30 includes, for example, a top section 32 extending substantially in a horizontal direction to be positioned on the top of the bath tub sidewall 19. The plate member 30 further includes a clamping section 34 extending downwardly from one side edge of the top section 32 in a substantially vertical direction for abutting one side of the bath tub sidewall 19, and a connecting section 36 (may be shaped in a triangular shape) substantially parallel to the clamping section 34 and joined with a low end of the clamping section 34 in a U-shaped configuration (not indicated). The top section 32, clamping section 34 and connecting section 36 may be made by individual plates being welded together to form the plate member 30, or may be made integrally of a single metal plate in a bending and pressing process. The plate member 30 is attached to the joining body (metal bar 20) by, for example, welding one end of the metal bar 20 to an upper part of the connecting section 36 and welding the opposite sidewalls 24, 26 of the metal bar 20 (see FIG. 5) at the low edges thereof, to a top surface of the top section 32, thereby forming a rigid configuration of the first clamping member 16. An opening 38 is provided at a top portion of the connecting section 36 of the plate member 30, aligning with the channel 28 of the metal bar 20.

The second clamping member 18 includes, for example, a joining body such as a metal bar 40 in an L-shape including a substantially horizontal arm 42 and a downwardly extending arm 44. The metal bar 40 has a hollow configuration similar to that of metal bar 20 but in a smaller size (see FIG. 5), including opposite sidewalls 48, 50 connected together by a middle wall 46, thereby defining a rectangular or square hollow cross-sectional configuration having an open channel (not indicated), to be slideably received in the channel 28 of the metal bar 20. A clamping plate 52 which may be made of a metal plate, is attached to the downwardly extending arm 44 of the metal bar 40, for example by welding, for abutting the other side of the bath tub sidewall 19. Reinforcement brackets 54 may be welded to the clamping plate 52 and the downwardly extending arm 44 to strengthen the attachment of the clamping plate 52 to the joining body (the metal bar 40).

A set of a bolt 56, a washer 58 and a nut 60 are provided for adjusting a space between the clamping section 34 of the first clamping member 16 and the clamping plate 52 of the second clamping member 18. The nut 60 is attached, for example by welding, to an open end of the substantially horizontal arm 42 of the metal bar 40 for operatively receiving the bolt 56 which extends through the washer 58, the opening 38 in the connecting section 36 of the plate member 30, then through the channel 28 of the metal bar 20 (see FIG. 5) and through the nut 60, and may further extend into the inside of the hollow configuration (the open channel not indicated) of the substantially horizontal arm 42 of the metal bar 40.

Optionally, resilient pads, such as rubber pads 62, 64 and 66 may be attached to a surface of the respective clamping section 34, top section 32 of the plate member 30 and clamping plate 52, which abut or contact the bath tub sidewall 19.

A connecting tube which may be a cylindrical metal tube 67 is attached, for example by welding, to the metal bar 20 of the first clamping member 16 and extends upwardly therefrom. The cylindrical metal tube 67 may have an enlarged low end portion 68 which has a diameter greater than the width of the metal bar 20. A portion of the cylindrical wall at respectively diametrically opposite sides of the enlarged low end portion 68, is cut away to allow the metal bar 20 to extend through the enlarged low end portion 68, in a direction traverse to that of the cylindrical metal tube 67. Welding is applied between the cut edges of the enlarged low end portion 68 of the cylindrical metal tube 67 and the metal bar 20 to strengthen the attachment of the cylindrical metal tube 67 to the first clamping member 16.

Figure 1:
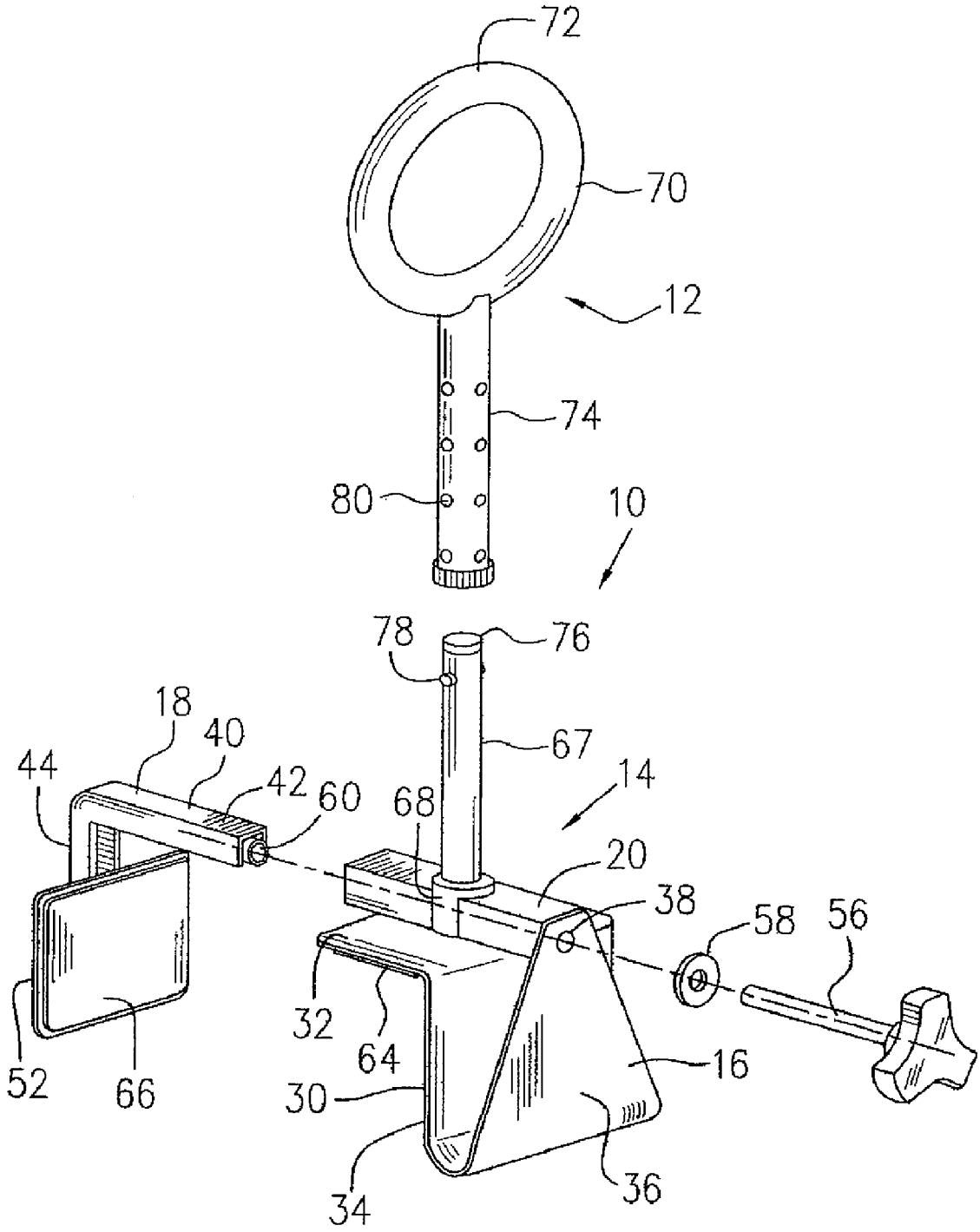
FIG. 1 is an exploded isometric view from one side of a bath tub rail assembly according to one embodiment of the invention.

Referring to FIGS. 1-3, the hand grip device 12 of the bath tub rail assembly 10 generally includes a hand grip, for example, a metal grip ring 70 standing in a substantially upright position. The grip ring 70 may be optionally configured in an elliptical shape to define at least a substantially horizontal section 72 to be comfortably gripped by a user's hand. Another connecting tube, for example a cylindrical metal tube 74 is attached at its upper end by, for example, welding to a low section of the upright standing grip ring 70. The cylindrical metal tube 67 connected to the clamping device 14 through the first clamping member 16 and the cylindrical metal tube 74 connected to the grip ring 70, are slidably connected to form an adjustable connector between the hand grip device 12 and the clamping device 14 to allow a position of the grip ring 70 to be adjusted in both height and angular orientation relative to the bath tub side wall to which the bath tub rail assembly 10 is attached.

As an example of the telescoping configuration of the adjustable connector, the cylindrical tube 74 may be an outer tube and have an inner diameter greater than an outer diameter of the cylindrical tube 67 (an inner tube) such that the cylindrical tube 67 may be slidably inserted through an open low end into the cylindrical tube 74. A lock device, for example, a spring biased lock pin device 76 may be attached within the cylindrical tube 67 (the inner tube) from the top end thereof. At least one lock pin 78 under a spring force, projects radially outwardly from a small hole (not indicated) defined in the cylindrical tube 67. According to the embodiment illustrated in FIGS. 1 and 2, a pair of lock pins 78 project in diametrically opposite directions from the cylindrical tube 67. The lock pin 78 can be pressed into the cylindrical wall of the cylindrical tube 67 by the cylindrical wall of the cylindrical tube 74 (the outer tube) when the cylindrical tube 67 (the inner tube) slides into and/or rotates within the cylindrical tube 74 (the outer tube). The spring biased lock pin device 76 is well known in the art and will not be further described herein.

Figure 4:
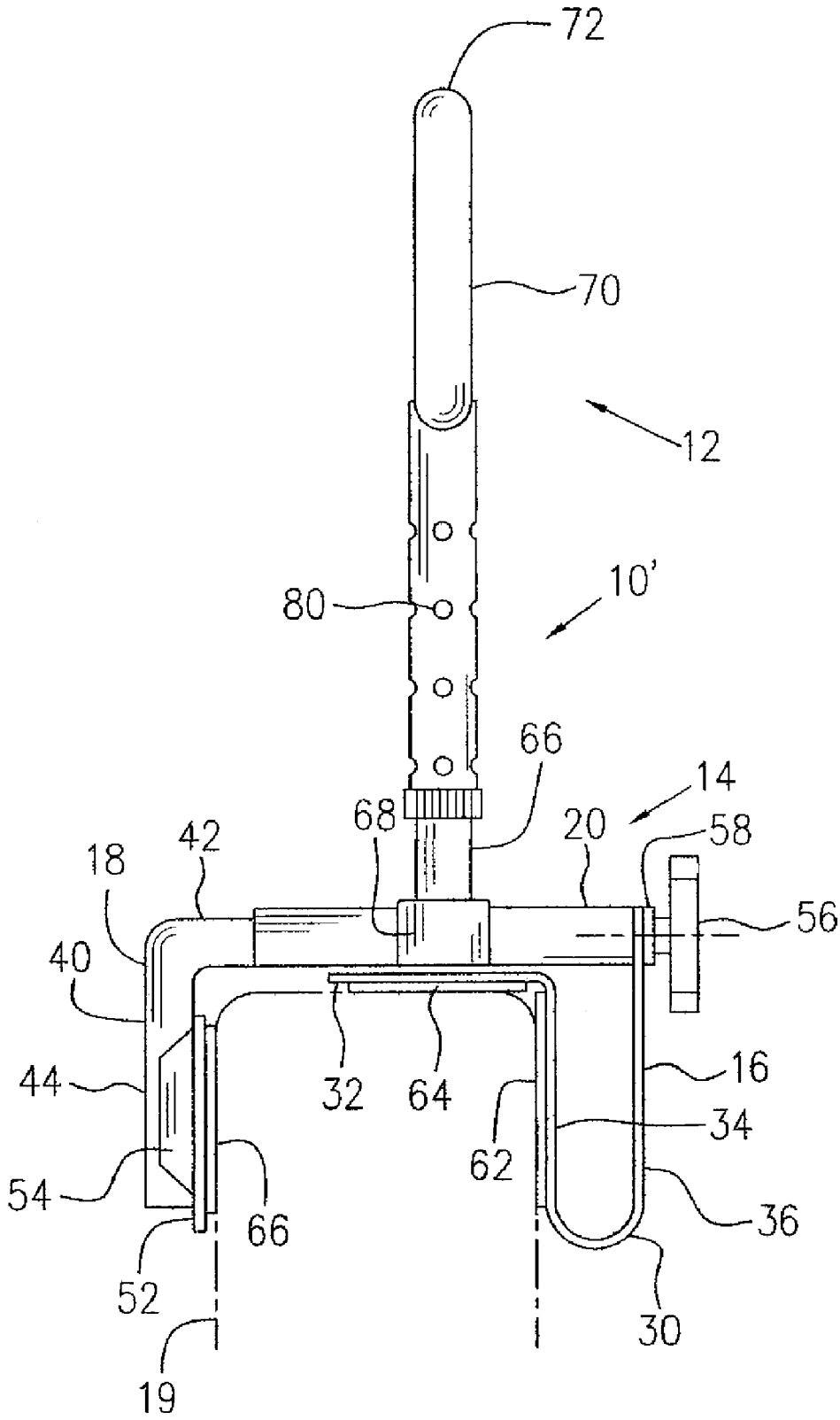
FIG. 4 is a front elevational view of the bath tub rail assembly according to another embodiment of the present invention, showing the hand grip of the assembly adjusted in a second low position and in an angular orientation substantially parallel to the bath tub sidewall.

A plurality of positioning holes 80 may be defined in the cylindrical wall of the outer tube (cylindrical tube 74), which are distributed in different heights relative to the angular orientation of the low end of the tube and in different angular positions relative to the angular orientation of the grip ring 70. For example, the positioning holes 80 may be defined in at least two columns (not indicated), and the two columns of the holes 80 may be spaced apart substantially by a quarter of the circumference of the cylindrical tube 74. Therefore, when at least one lock pin 78 engages a positioning hole 80 selected from either one of the columns, the grip ring 70 can be oriented in one of two angular positions substantially perpendicular to each other. For example, one angular orientation of the grip ring 70 can be in a direction substantially transverse to the bath tub sidewall 19 as illustrated in FIG. 3 and the other angular orientation of the grip ring 70 can be substantially in the same direction as the bath tub sidewall 19, as illustrated in FIG. 4. When a different positioning hole 80 in the same column is selected to be engaged with the at least one lock pin 78, the grip ring 70 can be locked in a different height position while maintaining the same angular orientation. It should be understood that the grip pin 70 can be adjusted in either height or angular orientation and can also be adjusted in both height and angular orientation. Positioning holes 80 may be defined in four columns circumferentially equally spaced apart in accordance with the two diametrically oppositely positioned lock pins 78, such that the two lock pins 78 will be engaged with two holes defined in the respective diametrically oppositely defined columns in order to increase the locking strength of the telescoping connection of the cylindrical tubes 67 and 74.

The number of positioning holes in each column may be determined according to how many height levels of the grip ring 70 are desired. If more than two angular positions of the grip ring 70 are desired, this may be achieved either by adding more columns of the positioning holes 80 or add more lock pins 78 in different angular positions in the cylindrical tube 67. In the latter case, selecting one of differently angularly positioned lock, pins 78 to engage with a same positioning hole 80 or a different positioning hole 80 but in the same column, will change the orientation of the grip ring 70. A combination of selective lock pins and selective columns of positioning holes may provide more selective angular positions of the hand grip.

FIG. 4 illustrates another embodiment of the present invention in which a bath tub rail assembly 10' is substantially similar to the bath tub rail assembly 10 illustrated in FIGS. 1-3. Therefore, like components are indicated by similar numerals and will not be redundantly described herein. Only the difference between the two embodiments is described below.

In contrast to the bath tub rail assembly 10 illustrated particularly in FIG. 3, in which the plate member 30 is attached to the metal bar 20 both at a upper part of the connecting section 36 (to an end of the metal bar 20), and at a top surface of the top section 32 (to the sidewalls of the metal bar 20) to form a relatively strong and rigid configuration of the first clamping member 16, the plate member 30 of the bath tub rail assembly 10' in FIG. 4 is attached only at the upper part of the connecting section 36 to the end of the metal bar 20. The top section 32 of the plate member 30 in the bath tub rail assembly 10', however, is not attached to the metal bar 20 and therefore, becomes a free end portion of the plate member 30. Thus, the U-shaped configuration between the clamping section 34 and the connecting section 36 acts as a spring to provide a resilient force therebetween when the bolt 56 is tightened to compress the first and second clamping members 16 and 18 against the opposite sides of the bath tub sidewall 19.

The U-shaped configuration of the first clamping member 16 with a free end (in the assembly 101 in FIG. 4), is less strong and rigid than the first clamping member 16 of the bath tub rail assembly 10 of FIG. 3 which has both ends attached to the metal bar 20. Nevertheless, the resiliency provided by the U-shaped configuration of the plate member 30 in the bath tub rail assembly 10' provides a more stable self-locking condition for the clamping device 14. It should be noted that the material of the plate member 30 and the proper dimensions thereof should be selected to provide an appropriate resiliency between the clamping section 34 and the connecting section 36 in order to avoid the clamping device 14 becoming too soft to achieve a secure attachment onto the bath tub sidewall 19.

The above description is meant to be exemplary only, and one skilled in the art will recognize that changes may be made to the embodiments described without departure from the scope of the invention disclosed. For example, the materials used for the bath tub rail assembly may be metal materials such as steel tubes, plates but may also be of other materials having similar mechanical properties suitable for this application. The hand grip may be configured other than a grip ring, such as a hand grip bar, etc. The joining bodies of the clamping device may be configured differently from the metal bars described in the above embodiments. The inner and outer tubes in the telescoping connection may not be cylindrical but may be in other shaped configurations such as squares. Still other modifications which fall within the scope of the present invention will be apparent to those skilled in the art in light of a review of this disclosure and such modifications are intended to fall within the appended claims.

We claim:

1. A bath tub rail assembly for use on a bath tub sidewall, comprising:

a hand grip;

a clamping device having first and second clamping members adjustable relative to each other for clamping opposite sides of the bath tub sidewall in order to secure the bath tub rail assembly onto the bath tub sidewall;

an adjustable connector for connecting the hand grip to the clamping device, having a telescoping configuration including a first tube affixed to one of the hand grip and the clamping device, and a second tube affixed to the other of the hand grip and the clamping device, so as to allow a position of the hand grip to be adjusted in both height and angular orientation relative to the bath tub sidewall; and wherein the first and second tubes are cylindrical, the first tube having an inner diameter greater than an outer diameter of the second tube, and defining a plurality of holes at least in two columns through a tube wall of the first tube, the two columns of the holes being spaced apart substantially by a quarter of a circumference of the first tube, and wherein the second tube includes a lock member to be selectively engaged within the respective holes of the first tube, for locking the hand grip in both a selected height position and a selected angular orientation.

2. The bath tub rail assembly as defined in claim 1 wherein the hand grip comprises a section thereof extending in a substantially horizontal direction.

3. The bath tub rail assembly as defined in claim 1 wherein the hand grip comprises a grip ring.

4. The bath tub rail assembly as defined in claim 1 wherein the hand grip comprises a substantially horizontal section selectively extending in one of a first angular orientation substantially parallel to the bath tub sidewall and a second angular orientation substantially perpendicular to the bath tub sidewall.

5. The bath tub rail assembly as defined in claim 1 wherein the first and second clamping members comprise respective first and second joining bodies with first and second downwardly extending plates attached to the respective first and second joining bodies, one of the first and second joining bodies being connected to the adjustable connector, and the first and second joining bodies being adjustably connected together to adjust a distance between the first and second plates.

6. The bath tub rail assembly as defined in claim 5 wherein the first clamping member comprises a configuration resiliently connecting the first plate to the first joining body to allow a resilient force to be applied between the first plate and the first joining body.

7. A bath tub rail assembly for use on a bath tub sidewall, comprising:

a hand grip including grip ring standing substantially upright;

a clamping device having first and second clamping members adjustable relative to each other for clamping opposite sides of the bath tub sidewall to secure the bath tub rail assembly onto the bath tub sidewall; and an adjustable connector for connecting the hand grip and the clamping device, the adjustable connector including a pair of connected inner and outer tubes slidable to each other and affixed to the grip ring and the first clamping member, respectively, the outer tube defining a plurality of holes at least in two columns and the inner tube including an lock pin to be selectively engaged within one of the holes in either column of the outer tube, thereby allowing secure positioning of the grip ring of the hand grip in both a selected height and a selected angular orientation relative to bath tub sidewall.

8. The bath tub rail assembly as defined in claim 7 wherein the first clamping member comprises a first joining body affixed to one of the outer and inner tubes and a plate member attached to the first joining body, the plate member including a top section adapted to be positioned on a top of the bath tub sidewall, a clamping section extending downwardly from one side edge of the top section for abutting one side of the bath tub sidewall, and a connecting section joined with a low end of the clamping section in a U-shaped configuration and extending substantially upright, the connecting section being affixed at a upper part to the first joining body; wherein the second clamping member includes a second joining body and a clamping plate attached to the second joining body for abutting the other side of the bath tub sidewall, the second joining body being adjustably connected to the first joining body of the first clamping member to adjust a distance between the clamping plate of the second clamping member and the clamping section of the first clamping member.

9. The bath tub rail assembly as defined in claim 8 wherein the top section of the plate member is affixed to the first joining body of the first clamping member.

10. The bath tub rail assembly as defined in claim 8 wherein the first and second joining bodies comprise a hollow configuration to allow the second joining body to be inserted into the first joining body and to allow a connecting bolt to extend through the first joining body into the second joining body, causing a sliding movement between the first and second joining bodies, thereby creating a clamping force to the bath tub sidewall.

* * * * *